US011297947B2

(12) United States Patent
Murphy

(10) Patent No.: US 11,297,947 B2
(45) Date of Patent: Apr. 12, 2022

(54) RECLINING SEATING UNIT WITH WALL-PROXIMITY CAPABILITY

(71) Applicant: Ultra-Mek, Inc., Denton, NC (US)

(72) Inventor: Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 0 days.

(21) Appl. No.: 17/037,911

(22) Filed: Sep. 30, 2020

(65) Prior Publication Data

US 2021/0100364 A1 Apr. 8, 2021

Related U.S. Application Data

(60) Provisional application No. 62/912,225, filed on Oct. 8, 2019.

(51) Int. Cl.
*A47C 1/0355* (2013.01)
*A47C 1/022* (2006.01)

(52) U.S. Cl.
CPC ..... *A47C 1/0355* (2013.01); *A47C 1/022* (2013.01)

(58) Field of Classification Search
CPC .... A47C 1/0355; A47C 1/03211; A47C 1/022
USPC ..... 297/85 M
See application file for complete search history.

(56) References Cited

U.S. PATENT DOCUMENTS 2,919,744 A 1/1960 Akira
3,758,151 A 9/1973 Re
4,077,663 A 3/1978 Cycowicz et al.
4,337,977 A 7/1982 Rogers et al.
4,365,836 A * 12/1982 Jackson ..... A47C 1/03211 297/330
4,531,778 A 7/1985 Rogers
4,805,960 A 2/1989 Tacker
5,588,710 A 12/1996 Wiecek
5,992,930 A 11/1999 LaPointe et al.
6,089,660 A 7/2000 Sproule
8,752,890 B2 6/2014 Murphy et al.
(Continued)

FOREIGN PATENT DOCUMENTS

WO 2014139179 A1 9/2014

OTHER PUBLICATIONS

"International Search Report and Written Opinion corresponding to International Application No. PCT/US2020/053275 dated Jan. 13, 2021".

*Primary Examiner* — Milton Nelson, Jr.
(74) *Attorney, Agent, or Firm* — Myers Bigel, P.A.

(57) ABSTRACT

A wall-proximity reclining seating unit includes: a frame having a back member and a pair of arms; a backrest; a seat; a footrest; a reclining mechanism connected between the frame, backrest, seat, and footrest, the reclining mechanism configured to move the seating unit between: (a) an upright position, in which the footrest is retracted below a forward portion of the seat; (b) a TV position, in which the backrest substantially maintains its angle, the seat substantially maintains its angle, and the first footrest is disposed in front of the seat; and (c) a fully reclined position, in which the backrest is disposed at a shallower angle, the footrest remains positioned in front of the seat, and the seat is moved forward of its position in the TV position; and a linear actuator comprising an energizing unit, a rail, and a carriage connected with the reclining mechanism.

20 Claims, 7 Drawing Sheets

(56) References Cited

U.S. PATENT DOCUMENTS

| | | | | |
|---|---|---|---|---|
| 2008/0036248 | A1 | 2/2008 | Beaver et al. | |
| 2012/0104827 | A1* | 5/2012 | Murphy | A47C 1/0345 297/85 M |
| 2016/0302573 | A1* | 10/2016 | Garland | A47C 1/036 |

* cited by examiner

RECLINING SEATING UNIT WITH WALL-PROXIMITY CAPABILITY

RELATED APPLICATION

The present application claims priority to and the benefit of U.S. Provisional Patent Application No. 62/912,225, filed Oct. 8, 2019, the disclosure of which is hereby incorporated by reference herein in full.

FIELD OF THE INVENTION

The present invention relates generally to seating units, and relates more particularly to reclining seating units.

BACKGROUND OF THE INVENTION

Recliner chairs and other reclining seating units have proven to be popular with consumers. These seating units typically move from an upright position, in which the backrest is generally upright, to one or more reclined positions, in which the backrest pivots to be less upright. The movement of the seating unit between the upright and reclined positions is typically controlled by a pair of matching reclining mechanisms that are attached to the seat, backrest and base of the chair.

One particularly popular reclining chair is the so-called "wall-proximity" chair. In a conventional reclining chair, as the backrest moves to the reclined position, the upper end of the backrest moves rearwardly relative to the base of the chair. As a result, typically the chair cannot be positioned such that the backrest is adjacent a wall, as the reclining backrest would strike the wall and thereby be prevented from fully reclining. A "wall-proximity" reclining chair includes some type of mechanism (typically either a linkage or a set of wheels that roll on a track) that move the seat of the chair forward relative to the base to provide additional room for the backrest to recline. Typically, such chairs are configured so that the seat and backrest move forward relative to the base when the chair moves from an upright position to a partially reclined "TV" position, in which the footrest is extended. The seat and backrest then move farther forward relative to the base as the chair from the TV position to its fully reclined position. Exemplary wall-proximity chairs are illustrated in U.S. Pat. No. 4,077,663 to Cycowicz et al., U.S. Pat. No. 4,337,977 to Rogers et al., U.S. Pat. No. 4,531,778 to Rogers, U.S. Pat. No. 4,805,960 to Tacker, U.S. Pat. No. 5,588,710 to Wiecek, and U.S. Pat. No. 5,992,930 to LaPointe et al., and in U.S. Patent Publication No. 20080036248 to Murphy et al., the disclosures of each of which are hereby incorporated herein in their entireties. A typical wall-proximity chair in its upright position can be placed with the backrest within 3 to 4 inches of an adjacent wall and still avoid striking the adjacent wall when moved to the fully reclined position.

One potential shortcoming of wall-proximity chairs is that the wall-proximity mechanism or wheel/rail system is typically somewhat complex, with multiple interconnected intricate parts. As such, production of these mechanisms can be relatively expensive. Also, the mechanisms that control the movement of wall-proximity chairs tend to be rather bulky, and therefore may be unsuitable for some specialized chairs. For example, some chairs have a "high leg" style in which the arms of the chair are raised several inches off of the underlying surface (typically between about 2 and 5 inches). It is ordinarily undesirable for portions of a reclining mechanism to be visible in the space below the chair when the chair is in the upright position, so designers/inventors are faced with providing a reclining mechanism that folds into a relatively small package that is not visible from the side in the upright position.

SUMMARY

As a first aspect, embodiments of the invention are directed to a wall-proximity reclining seating unit. The wall-proximity seating unit comprises: a frame having a back member and a pair of arms, the back member extending between the arms; a backrest; a seat having a seat frame; a first footrest; a reclining mechanism connected between the frame, backrest, seat, and first footrest, the reclining mechanism comprising a series of pivotally interconnected links and configured to move the seating unit between: (a) an upright position, in which the backrest is disposed at a first generally upright backrest angle, the seat is disposed at a first generally horizontal seat angle, and the first footrest is retracted below a forward portion of the seat; (b) a TV position, in which the backrest substantially maintains the first backrest angle, the seat substantially maintains the first seat angle, and the first footrest is disposed generally horizontally and in front of the seat; and (c) a fully reclined position, in which the backrest is disposed at a second backrest angle that is shallower than the first backrest angle, the first footrest remains positioned in front of the seat, and the seat is moved forward of its position in the TV position between about 8 and 10 inches; and a linear actuator comprising an energizing unit, a rail, and a carriage that is movable along the rail, wherein the carriage is connected with the reclining mechanism. The reclining mechanism includes a footrest linkage that is configured to move the first footrest between the upright and TV positions, and further includes a reclining linkage that is configured to move the seat and backrest relative to the frame from the TV position to the fully reclined position.

As a second aspect, embodiments of the invention are directed to a wall-proximity reclining seating unit comprising: a frame having a rearmost upper back member and a pair of arms; a backrest; a seat having a seat frame; a first footrest; a reclining mechanism connected between the frame, backrest, seat, and first footrest, the reclining mechanism comprising a series of pivotally interconnected links and configured to move the seating unit between: (a) an upright position, in which the backrest is disposed at a first generally upright backrest angle, the seat is disposed at a first generally horizontal seat angle, and the first footrest is retracted below a forward portion of the seat; (b) a TV position, in which the backrest substantially maintains the first backrest angle, the seat substantially maintains the first seat angle, and the first footrest is disposed generally horizontally and in front of the seat; and (c) a fully reclined position, in which the backrest is disposed at a second backrest angle that is shallower than the first backrest angle and an uppermost end of the backrest is positioned in front of the rearmost back member, the first footrest remains positioned in front of the seat, and the seat is moved forward of its position in the TV position; and a linear actuator comprising an energizing unit, a rail, and a carriage that is movable along the rail, wherein the carriage is connected with the reclining mechanism. The reclining mechanism includes a footrest linkage that is configured to move the first footrest between the upright and TV positions, and further includes a reclining linkage that is configured to move the seat and backrest relative to the frame from the TV position to the fully reclined position.

As a third aspect, embodiments of the invention are directed to a wall-proximity reclining seating unit comprising: a frame having a back member and a pair of arms, the back member extending between the arms; a backrest; a seat having a seat frame; a first footrest; a reclining mechanism connected between the frame, backrest, seat, and first footrest, the reclining mechanism comprising a series of pivotally interconnected links and configured to move the seating unit between: (a) an upright position, in which the backrest is disposed at a first generally upright backrest angle, the seat is disposed at a first generally horizontal seat angle, and the first footrest is retracted below a forward portion of the seat; (b) a TV position, in which the backrest substantially maintains the first backrest angle, the seat substantially maintains the first seat angle, and the first footrest is disposed generally horizontally and in front of the seat; and (c) a fully reclined position, in which the backrest is disposed at a second backrest angle that is shallower than the first backrest angle; and a linear actuator comprising an energizing unit, a rail, and a carriage that is movable along the rail, wherein the carriage is connected with the reclining mechanism. The reclining mechanism includes a footrest linkage that is configured to move the first footrest between the upright and TV positions, and further includes a reclining linkage that is configured to move the seat and backrest relative to the frame from the TV position to the fully reclined position. The reclining linkage comprises a foundation link mounted to one of the arms, a carrier link, front and rear recline links pivotally attached to the foundation link and the carrier link, and front and rear pivot links pivotally attached to the carrier link and to the seat frame.

DETAILED DESCRIPTION

Figure 1:
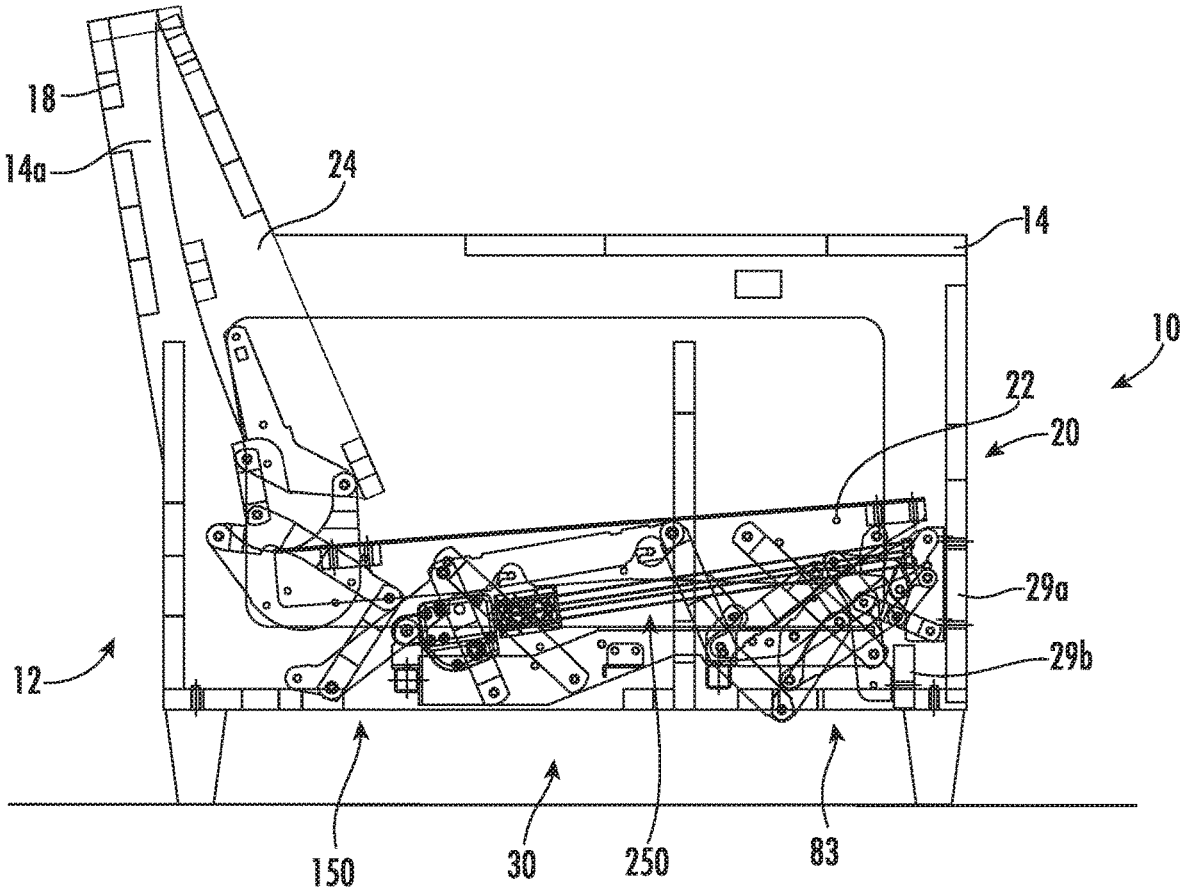
FIG. 1 is a side view of a wall-proximity reclining chair according to embodiments of the invention, the chair shown in the upright position.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

The seating units illustrated and described herein comprise a plurality of pivotally interconnected links. Those skilled in this art will appreciate that the pivots between links can take a variety of configurations, such as pivot pins, rivets, bolt and nut combinations, and the like, any of which would be suitable for use with the present invention. Also, the shapes of the links may vary as desired, as may the locations of certain of the pivots. Moreover, in some instances combinations of pivot points may be replaced by equivalent structures, such as "slider-crank" configurations, like those described in B. Paul. *Kinematics and Dynamics of Planar Machinery* 4-21 (1979).

Referring now to the figures, a reclining wall-avoiding seating unit, designated broadly at 10, is shown in FIGS. 1-6. The seating unit 10 includes a frame 12 having two opposed arms 14 connected by multiple cross-members 16. Specifically, the frame 12 includes a back section 18 that spans upper end portions 14*a* of the arms 14, and is supported by feet 19, which may be between 2 to 4 inches in height or more. The seating unit 10 also includes a seat 20 with a cushion (not shown) that overlies a seat frame 22, a backrest 24, and main and auxiliary footrests 29*a*, 29*b*.

The seat 20, the backrest 24 and the footrests 29*a*, 29*b* are interconnected by two mirror image reclining mechanisms 30. The mechanisms 30 are mirror images of each other about a longitudinal plane that divides the chair into left and right sides (see FIG. 7). As such, only one reclining mechanism 30 will be discussed in detail herein, with the understanding that the discussion is equally applicable to its mirror image mechanism. Also, the reclining mechanism 30 will be described first with respect to the fully reclined position (FIGS. 3 and 6) in order to illustrate more easily the interconnection of the various links thereof.

The reclining mechanism 30 includes a foundation link 190 is fixed to the inner surface of the arm 14*a* to provide mounting locations for multiple links of the reclining mechanism 30. The reclining mechanism includes a reclining linkage 150 that controls the movement of the backrest 24 and seat 20 relative to the frame 12, and further includes a footrest linkage 83 that controls the movement of the footrests 29*a*, 29*b* relative to the seat 20. These linkages 150, 83 are described in greater detail below.

The reclining linkage 150 includes a carrier link 152 that extends generally longitudinally. A lower rear pivot link 154 is mounted to the foundation link 190 at a pivot 156 and extends forwardly and upwardly therefrom. An angled upper rear pivot link 158 is attached at its lower end to the lower rear pivot link 154 at a pivot 160 and extends upwardly and slightly forwardly therefrom. A control link 162 is attached at its lower end to the vertex of the upper rear pivot link 158 at a pivot 164 and extends upwardly and slightly rearwardly to a pivot 166 with a backpost 165 fixed to the backrest 24. A saddle-shaped extension 168 is fixed to the rear end of the seat frame 22; the extension 168 is attached to the backpost 165 at a pivot 172 and to the upper end of the upper rear pivot link 158 at a pivot 170.

A rear recline link 174 is attached to the carrier link 152 at a pivot 176 and extends upwardly and slightly forwardly therefrom to a pivot 178 with the seat frame 22. A front recline link 208 is attached at its lower end to the forward end of the carrier link 152 at a pivot 212 and extends upwardly and slightly forwardly therefrom. At its upper end, the front recline link 208 is attached to the seat frame 22 at a pivot 205. A forward swing link 202 is attached to the carrier link 152 at a pivot 204 and to the forward end of the foundation link 190 at a pivot 206. A connecting link 220 is attached at its lower end to the forward end of the forward swing link 202 at a pivot 222 and to an intermediate region of the front recline link 208 at a pivot 224. A rear swing link 196 is attached to the carrier link 152 at a pivot 198 and extends upwardly and slightly rearwardly therefrom to a pivot 200 with the foundation link 190.

The footrest linkage 83 includes a lower footrest swing link 84 that is attached to the seat frame 22 at a pivot 85 and extends forwardly therefrom. An upper footrest swing link 88 is also attached to the seat frame 22 at a pivot 90 and extends forwardly therefrom. An upper footrest extension link 92 is attached to the forward end of the lower footrest swing link 84 at a pivot 94 and extends upwardly and forwardly therefrom. The upper footrest extension link 92 is also attached to the upper footrest swing link 88 at a pivot 93. A lower footrest extension link 96 is attached to the forward end of the upper footrest swing link 88 at a pivot 98 and extends forwardly and upwardly therefrom. A main footrest bracket 100 is attached to the forward end of the upper footrest extension link 92 and the lower footrest extension link 96 at, respectively, pivots 102, 104. The main footrest 29*a* is mounted on the main footrest bracket 100 (FIG. 3).

A lower auxiliary footrest swing link 110 is attached to the main footrest bracket 100 at the pivot 104, and an upper auxiliary footrest swing link 116 is attached to the main footrest bracket 100 at a pivot 118. An auxiliary footrest bracket 120 is attached to the front ends of the swing links 110, 116 at, respectively, pivots 122, 124. A control link 106 is attached to the forward end of the lower footrest extension link 96 at a pivot 108 and to the upper auxiliary footrest swing link 116 at a pivot 112. The auxiliary footrest 29*b* is mounted on the auxiliary footrest bracket 120 (FIG. 3).

Figure 2:
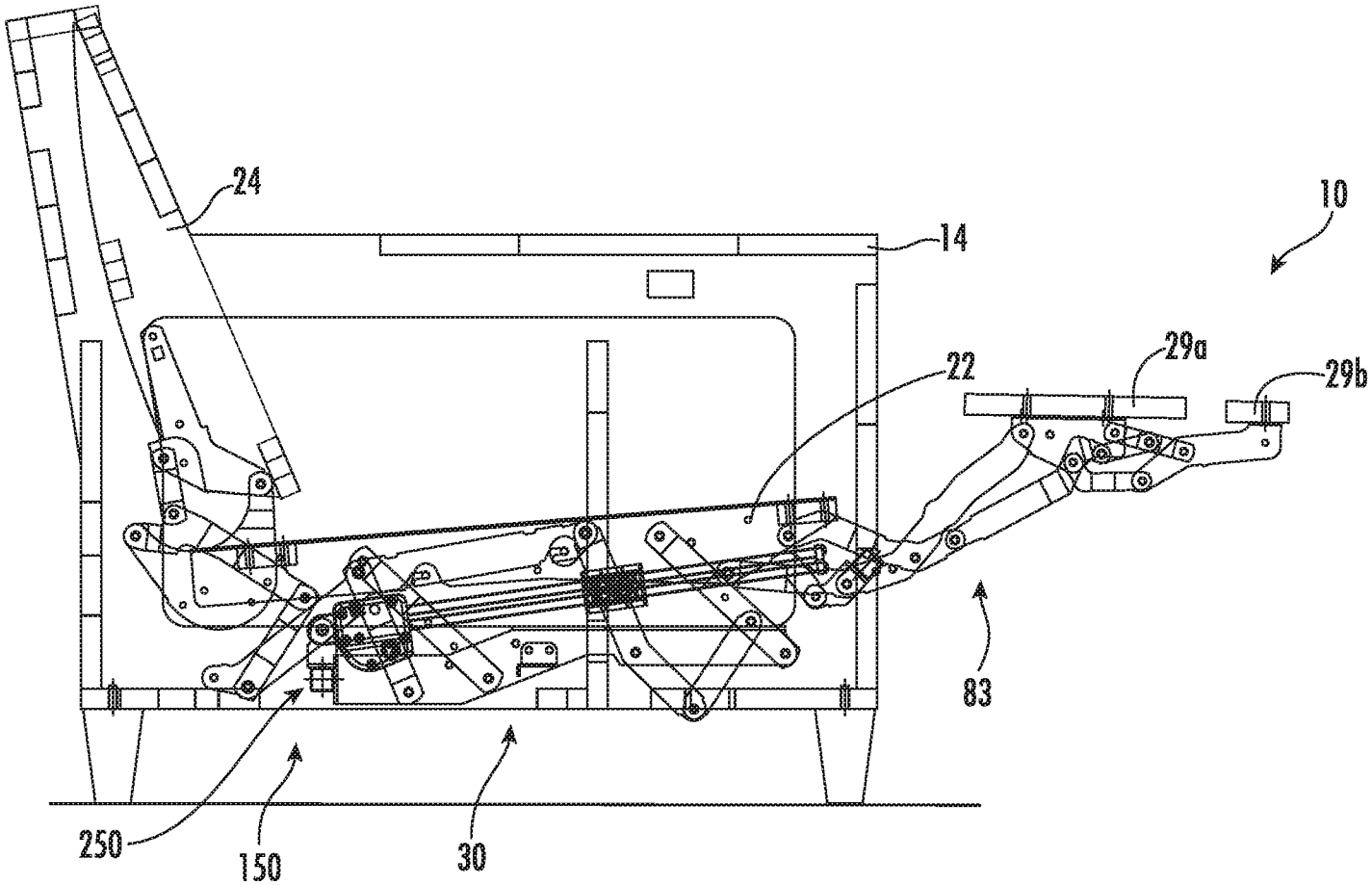
FIG. 2 is a side view of the chair of FIG. 1 shown in the TV position.
Figure 3:
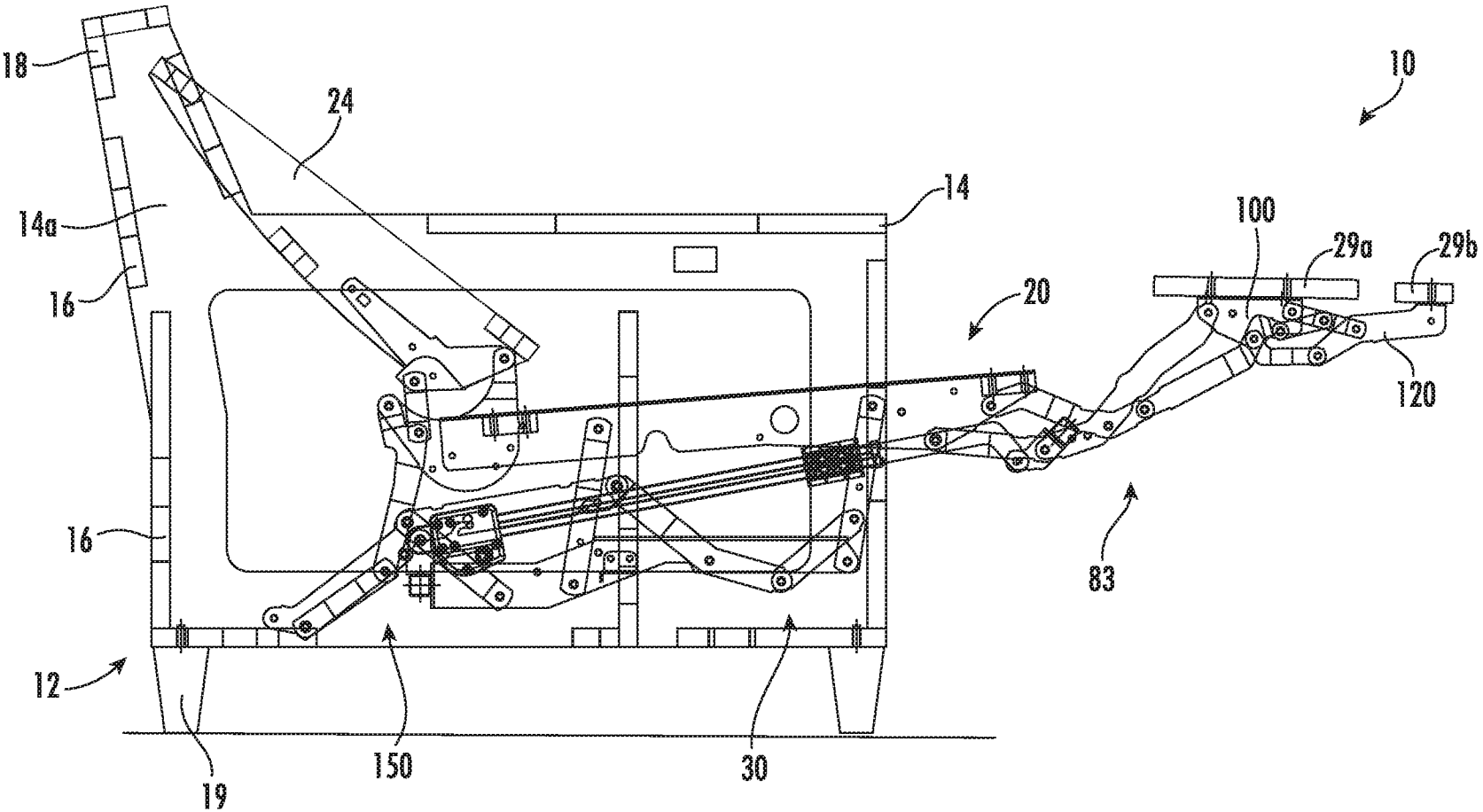
FIG. 3 is a side view of the chair of FIG. 1 shown in the fully reclined position.
Figure 5:
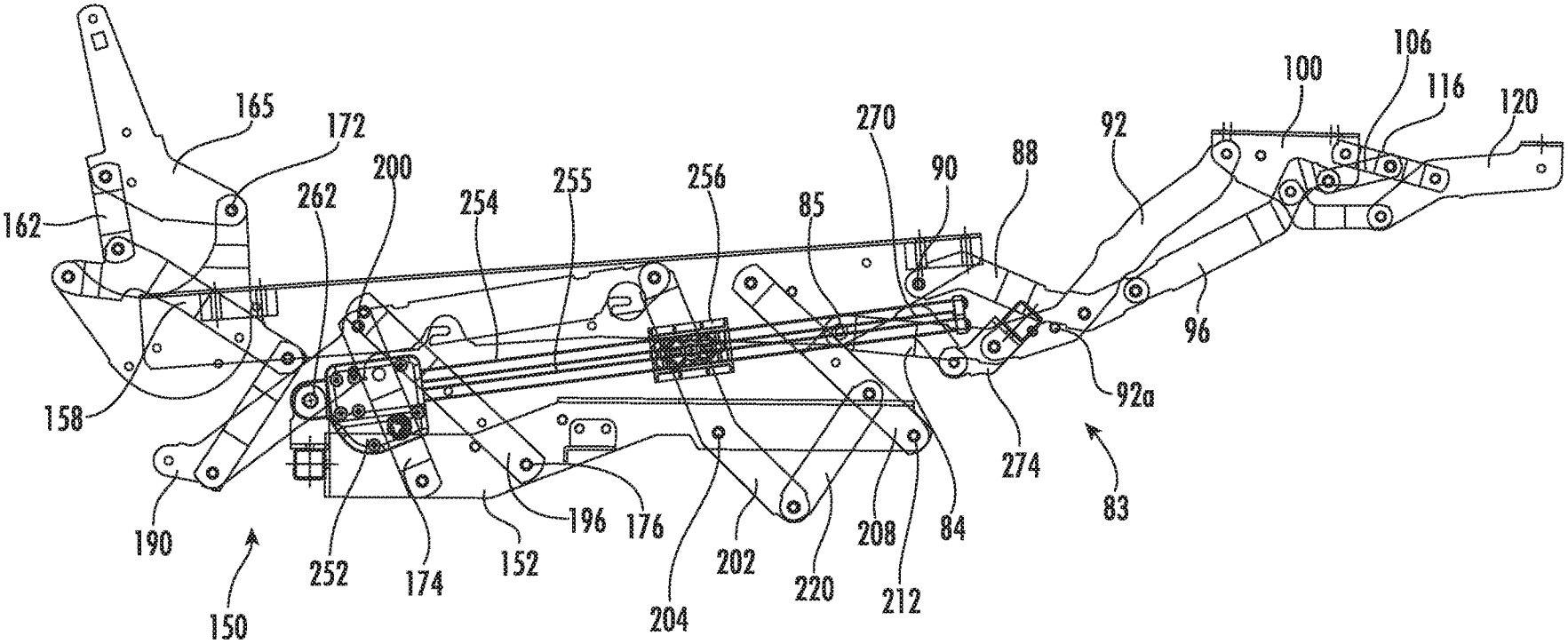
FIG. 5 is a side view of the mechanism of FIG. 4 shown in the TV position.
Figure 6:
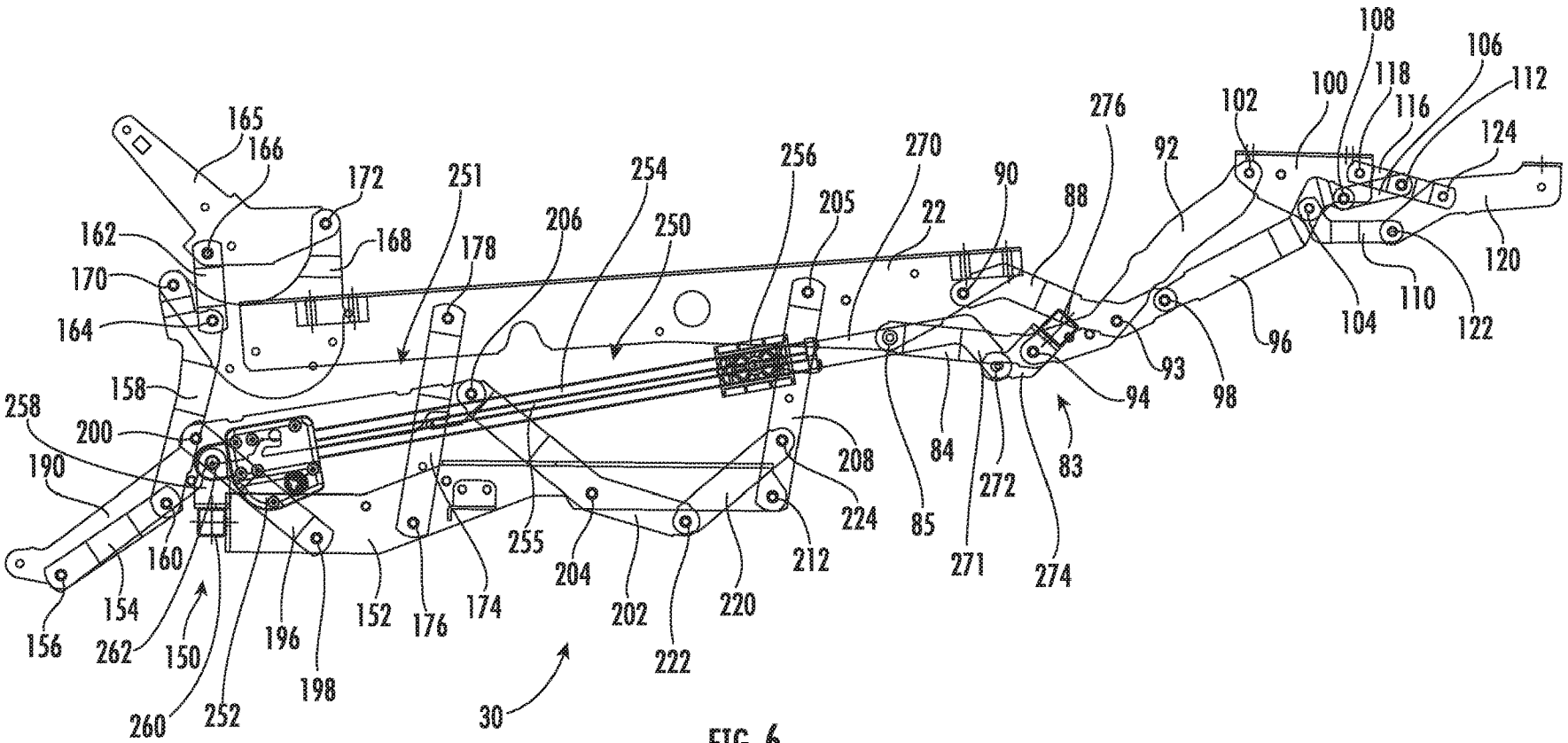
FIG. 6 is a side view of the mechanism of FIG. 4 shown in the fully reclined position.
Figure 7:
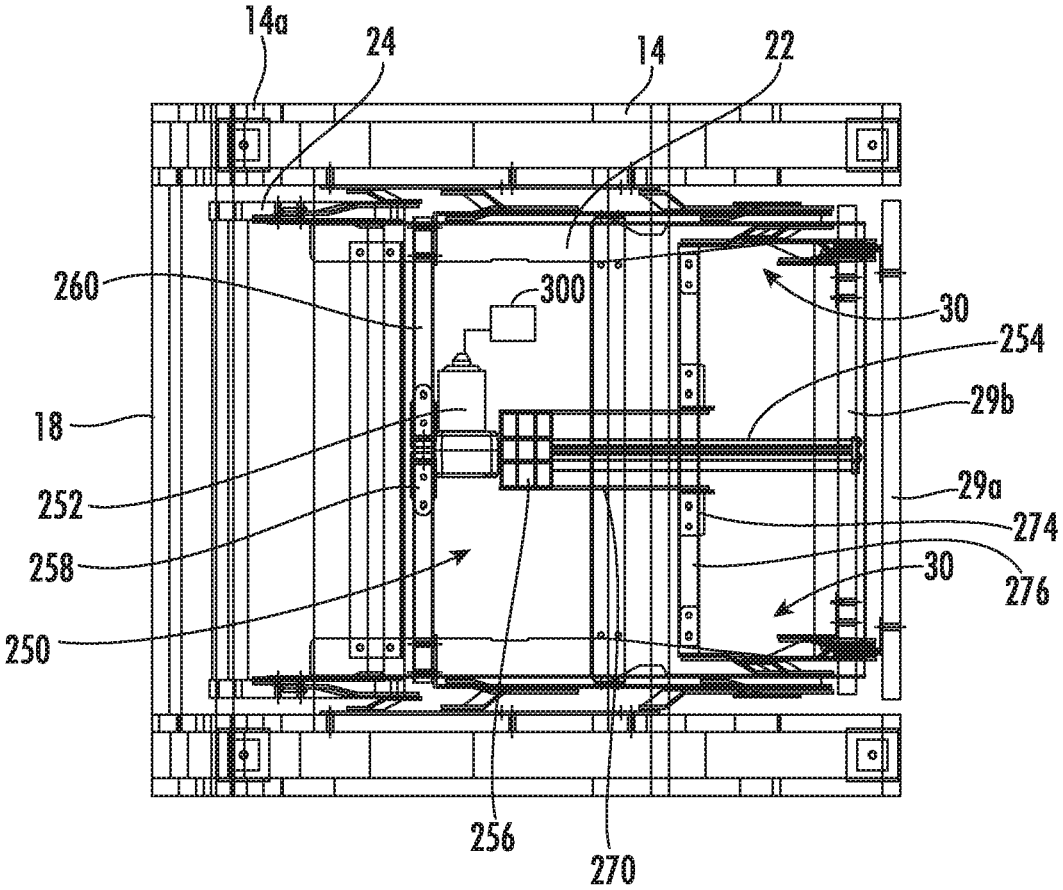
FIG. 7 is a top view of the chair of FIG. 1.

The seating unit 10 also includes an actuating unit 250 that drives the seating unit 10 between an upright position (shown in FIGS. 1 and 4), a TV position (shown in FIGS. 2 and 5), and a fully reclined position (shown in FIGS. 3 and 6). The actuating unit 250 includes a linear actuator 251 that comprises a motor 252, a rail 254, a threaded drive screw 255, and a carriage 256. A bracket 258 is mounted at a pivot 262 at the rear end of the linear actuator 250 near the motor 252. The bracket 258 is fixed to a cross-member 260 that is fixed to the rear ends of the carrier links 152. The carriage 256 is mounted to the drive screw 255 for longitudinal movement along the rail 254. A drive link 270 is fixed to and moves in concert with the carriage 256. The drive link 270 has a forward extension 271 that extends below the rail 254. A bracket 274 is pivotally mounted to the forward extension 271 of the drive link 270 at a pivot 272. The bracket is fixed to a cross-member 276 that extends to a fixed attachment with the forward ends of the lower footrest swing link 84. The motor 252 of the linear actuator 250 is operably connected to a power source (shown schematically at 300 in FIG. 7), which may be a battery, an electrical outlet accessible via a power cord, or the like. The motor 252 may also be connected to a control unit (e.g., a keypad, joystick, toggle switch, button, etc.) that initiates and ceases operation of the motor 252.

Figure 4:
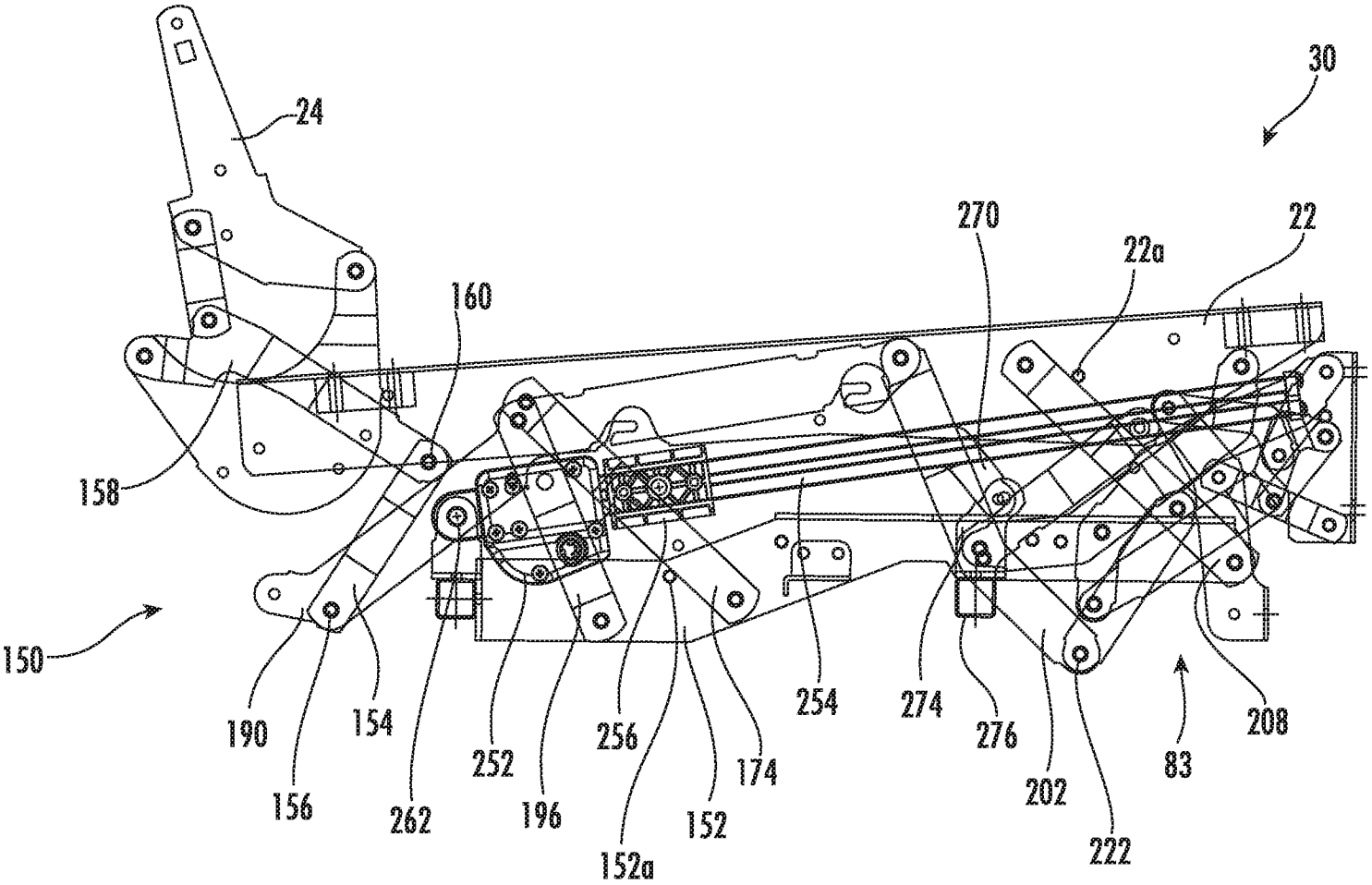
FIG. 4 is a side view of the reclining and footrest mechanism of the chair of FIG. 1 shown in the upright position.

In operation, the seating unit 10 may begin in the upright position shown in FIGS. 1 and 4. In the fully upright position, the carriage 256 of the linear actuator 250 is positioned at the rear of the rail 254 adjacent the motor 252. In this position, the drive link 270 is drawn rearwardly. The bracket 274 is rotated such that the cross-member 276 is lowered and positioned rearwardly of the pivot 272. The footrest linkage 83 is folded under the front portion of the seat 20, with the main footrest 29*a* generally vertically disposed just forward of the seat 20, and the auxiliary footrest 29*b* generally vertically disposed rearward of the main footrest 29*a*. In the fully upright position, the reclining linkage is disposed such that the rear swing link 196 and the forward swing link 202 are both disposed generally upright, but with a rearward lean. This arrangement positions the carrier link 152 such that its central section is above generally beneath the front end of the foundation link 190, and the forward end of the carrier link 152 is beneath and just rearward of the front end of the seat frame 22. The rear recline link 174 and the front recline link 208 are disposed with a more pronounced rearward lean than the rear and forward seat swing links 196, 202; they are maintained in their respective positions by pins 152*a*, 22*a*, which are located on the carrier link 152 and seat frame 22, respectively, and which engage edges of the rear recline link 174 and the front recline link 208. The result is that the seat frame 22 has a slight pitch (between about 2 and 7 degrees). The lower rear pivot link 154 extends generally forwardly and upwardly from the pivot 156, and the upper rear pivot link 158 extends upwardly and rearwardly from the pivot 160. As such, the backpost 165 (and in turn the backrest 24) are tilted slightly rearwardly (at an angle of between about 105 and 120 degrees relative to horizontal), with the backrest 24 in front of the back section 18 of the frame 12. As can be seen in FIG. 1, the back section 18 may be solid and extend both the full width and the full height of the frame 12, with the backrest 24 being positioned in front of the back section 18.

The height of the reclining mechanism 30 below the seat 20, measured from the lowest point (in this instance the lowest point is represented by the portions of the connecting link 220 and the front recline link 208 below the pivot 222) to the highest point on the seat frame 22, is between about 8 and 10 inches. This height can enable the seating unit 10 to have a conventional and comfortable seat height (typically between about 16 and 20 inches above the underlying floor) while enable the reclining mechanism 30 to be used with a "high leg" seating unit that has arms that may be between about 2 and 5 inches from the floor.

To move the seating unit 10 from the upright position to the TV position of FIGS. 2 and 5, the occupant energizes the motor 252 to rotate the drive screw 255 to drive the carriage 256 forwardly on the rail 254. The forward movement of the carriage 256 forces the drive link 270 forward. The forward movement of the drive link 270 draws the bracket 274 forward and forces the lower end of the lower footrest swing link 84 forward, thereby rotating the lower footrest swing link 84 counterclockwise about the pivot 85. The movement of the lower footrest swing link 84 drives the upper footrest extension link 92 forwardly, which in turn rotates the upper footrest swing link 88 about the pivot 90. Rotation of the upper footrest swing link 88 drives the lower footrest extension link 96 forwardly and causes it to separate slightly from the upper footrest extension link 92. The relative movement of the upper and lower footrest extension links 92, 96 rotates the main ottoman bracket 100 counterclockwise to a generally horizontal position. Relative rotation of the main ottoman bracket 100 and the lower footrest extension link 96 also forces the control link 106 away from the main footrest bracket 100, which extends the upper auxiliary footrest swing link 116 and, in turn, the auxiliary footrest bracket 120. Extension ceases when the upper footrest swing link 88 strikes a pin 92*a* on the upper footrest extension link 92, which occurs when the carriage 256 is approximately in the center of the rail 254. Additional aspects of the extension of the footrests 29*a*, 29*b* may be discussed in U.S. Pat. No. 8,752,890 to Murphy et al., the disclosure of which is hereby incorporated herein by reference in its entirety.

Notably, during the movement of the footrest linkage 83 between the upright and TV positions, the foundation link 190, the carrier link 152, and the seat frame 22 do not move relative to each other. Thus, the pitch of the seat 20 relative to the frame 12 and the incline of the backrest 24 relative to the seat 20 and frame 12 are essentially unchanged, which also indicates that any cushions employed with the seat 20 and backrest 24 are undisturbed by the movement of the seating unit 10 to the TV position. The seating unit 10 preferentially drives the footrest linkage 83 rather than the reclining linkage 150 because of the rearward disposition of the front and rear recline links 208, 174 and the front and rear swing links 202, 196. There is sufficient resistance to the clockwise pivoting of these links (provided in large part by the weight of the occupant on the seat 20) that these links remain in position as the footrest linkage 83 extends the footrests 29*a*, 29*b*.

It should also be noted that the linear actuator 250 can pivot relative to the carrier link 152 (and, thus, relative to the frame 12) by rotating slightly about the pivot 262.

To move the seating unit 10 from the TV position to the fully reclined position of FIGS. 3 and 6, the occupant energizes the motor 252 to impel the carriage 256 further forwardly along the rail 254 via the drive screw 255. Because the footrest linkage 83 is fully extended, additional force on the lower footrest swing link 84 cannot cause further movement in the footrest linkage 83; thus, additional force applied by the carriage 256 onto the lower footrest swing link 84 (through the bracket 274 and cross-member 276) begins to drive the seat frame 22 forwardly and slightly upwardly relative to the foundation link 152. This movement is controlled by the front and rear recline links 208, 174, each of which pivots clockwise about a respective pivot 212, 176. Clockwise rotation of the front recline link 208 also draws the connecting link 220 forward, which in turn rotates the forward swing link 202 counterclockwise about the pivot 204. This rotation drives the carrier link 152 forwardly and slightly upwardly relative to the foundation link 190 (this action is controlled in the rear by the rear swing link 196 pivoting counterclockwise about the pivot 200). Upward and forward movement of the seat frame 22 draws the upper end of the upper pivot link 158 forwardly, which in turn, through the control link 162, rotates the backpost 165 counterclockwise about the pivot 172 relative to the seat frame 22. This rotation of the backpost 165 rotates the backrest 24 relative to the seat 20. Reclining motion ceases when the carriage 256 reaches the frontmost end of the rail 254.

It can be seen in FIG. 3 that, in the fully reclined position, the lower end of the backrest 24 has moved forwardly considerably (typically between about 8 and 10 inches) from its position in the TV position. Thus, even though the backrest 24 is reclined (typically to an angle of between about 130 and 140 degrees with the seat 20), the upper end of the backrest 24 remains well forward of the back section 18 of the frame 12. As a result, the seating unit 10 may be appropriate for use with a "T-cushion" overlying the backrest 24. A T-cushion has "ears" that extend over the top of the arms 14 when the seating unit 10 is in the upright position. In many wall-proximity seating units, employment of T-cushions overlying the backrest are discouraged because the movement of the backrest and/or seat can cause the T-cushion to be dislodged from its preferred position, as the ears of the T-cushion catch on the arms during movement to the TV and/or fully reclined positions. The configuration of the seating unit 10 may enable movement between all positions without disturbing or dislodging a backrest T-cushion.

In addition, in the fully reclined position the seat frame 22 (and thus the seat 20) has moved forwardly relative to its position in the TV position between about 8 and 10 inches.

Those of skill in this art will appreciate that seating units according to embodiments of the invention may take other forms. For example, while a chair is shown herein, the reclining mechanisms 30 may be employed in other seating units, such as love seats, sofas, sectional sofas, and the like.

Also, in other embodiments the actuating mechanisms may vary as desired, including both manually-operated units and other power-actuated units. For example, "telescoping" linear actuators may replace the linear actuators that have a carriage that slides along a base rail as shown herein. However, the use of a linear actuator with a carriage may take advantage of the longer "stroke" to facilitate movement of the reclining mechanism.

Further, the seating unit 10 may have only one footrest, or may have three or more footrests in other embodiments. Other variations will be apparent to those of skill in this art.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A wall-proximity reclining seating unit, comprising:

a frame having a back member and a pair of arms, the back member extending between the arms;

a backrest;

a seat having a seat frame;

a first footrest;

a reclining mechanism connected between the frame, backrest, seat, and first footrest, the reclining mechanism comprising a series of pivotally interconnected links and configured to move the seating unit between: (a) an upright position, in which the backrest is disposed at a first generally upright backrest angle, the seat is disposed at a first generally horizontal seat angle, and the first footrest is retracted below a forward portion of the seat; (b) a TV position, in which the backrest substantially maintains the first backrest angle, the seat substantially maintains the first seat angle, and the first footrest is disposed generally horizontally and in front of the seat; and (c) a fully reclined position, in which the backrest is disposed at a second backrest angle that is shallower than the first backrest angle, the first footrest remains positioned in front of the seat, and the seat is moved forward of its position in the TV position between about 8 and 10 inches; and a linear actuator comprising an energizing unit, a rail, and a carriage that is movable along the rail, wherein the carriage is connected with the reclining mechanism;

wherein the reclining mechanism includes a footrest linkage that is configured to move the first footrest between the upright and TV positions, and further includes a reclining linkage that is configured to move the seat and backrest relative to the frame from the TV position to the fully reclined position, both the reclining linkage and the footrest linkage being driven by the linear actuator.

2. The seating unit defined in claim 1, wherein the reclining linkage and the footrest linkage are decoupled.

3. The seating unit defined in claim 1, wherein the reclining linkage comprises a foundation link mounted to one of the arms, a carrier link, front and rear recline links pivotally attached to the foundation link and the carrier link, and front and rear pivot links pivotally attached to the carrier link and to the seat frame.

4. The seating unit defined in claim 3, wherein the reclining linkage further comprises a connecting link pivotally attached to the front recline link and the front pivot link.

5. The seating unit defined in claim 3, wherein, as the seating unit moves from the TV position to the fully reclined position, the carrier link rises and moves forwardly relative to the foundation link and the seat frame rises and moves forwardly relative to the carrier link.

6. The seating unit defined in claim 3, wherein the reclining linkage further comprises a lower rear pivot link pivotally attached to the foundation link, an upper rear pivot link pivotally attached to the lower rear pivot link and to the seat frame, a control link that is pivotally attached to the upper rear pivot link, and a backpost that is pivotally attached to the control link and to the seat frame.

7. The seating unit defined in claim 3, wherein the linear actuator is pivotally attached to the carrier link.

8. The seating unit defined in claim 3, wherein the carriage is pivotally attached to the footrest mechanism.

9. The seating unit defined in claim 1, further comprising a second footrest attached to the reclining mechanism, the second footrest being generally vertically disposed and positioned rearwardly of the first footrest when the seating unit is in the upright position, and the second footrest being generally horizontally disposed forwardly of the first footrest when the seating unit is in the TV and fully reclined positions.

10. A wall-proximity reclining seating unit, comprising:

a frame having a rearmost upper back member and a pair of arms;

a backrest;

a seat having a seat frame;

a first footrest;

a reclining mechanism connected between the frame, backrest, seat, and first footrest, the reclining mechanism comprising a series of pivotally interconnected links and configured to move the seating unit between: (a) an upright position, in which the backrest is disposed at a first generally upright backrest angle, the seat is disposed at a first generally horizontal seat angle, and the first footrest is retracted below a forward portion of the seat; (b) a TV position, in which the backrest substantially maintains the first backrest angle, the seat substantially maintains the first seat angle, and the first footrest is disposed generally horizontally and in front of the seat; and (c) a fully reclined position, in which the backrest is disposed at a second backrest angle that is shallower than the first backrest angle and an uppermost end of the backrest is positioned in front of the rearmost back member, the first footrest remains positioned in front of the seat, and the seat is moved forward of its position in the TV position; and a linear actuator comprising an energizing unit, a rail, and a carriage that is movable along the rail, wherein the carriage is connected with the reclining mechanism;

wherein the reclining mechanism includes a footrest linkage that is configured to move the first footrest between the upright and TV positions, and further includes a reclining linkage that is configured to move the seat and backrest relative to the frame from the TV position to the fully reclined position.

11. The seating unit defined in claim 10, wherein the reclining linkage and the footrest linkage are decoupled.

12. The seating unit defined in claim 10, wherein the reclining linkage comprises a foundation link mounted to one of the arms, a carrier link, front and rear recline links pivotally attached to the foundation link and the carrier link, and front and rear pivot links pivotally attached to the carrier link and to the seat frame.

13. The seating unit defined in claim 12, wherein the reclining linkage further comprises a connecting link pivotally attached to the front recline link and the front pivot link.

14. The seating unit defined in claim 12, wherein, as the seating unit moves from the TV position to the fully reclined position, the carrier link rises and moves forwardly relative to the foundation link and the seat frame rises and moves forwardly relative to the carrier link.

15. The seating unit defined in claim 12, wherein the reclining linkage further comprises a lower rear pivot link pivotally attached to the foundation link, an upper rear pivot link pivotally attached to the lower rear pivot link and to the seat frame, a control link that is pivotally attached to the upper rear pivot link, and a backpost that is pivotally attached to the control link and to the seat frame.

16. The seating unit defined in claim 12, wherein the linear actuator is pivotally attached to the carrier link.

17. The seating unit defined in claim 12, wherein the carriage is pivotally attached to the footrest mechanism.

18. The seating unit defined in claim 10, further comprising a second footrest attached to the reclining mechanism, the second footrest being generally vertically disposed and positioned rearwardly of the first footrest when the seating unit is in the upright position, and the second footrest being generally horizontally disposed forwardly of the first footrest when the seating unit is in the TV and fully reclined positions.

19. The seating unit defined in claim 10, wherein the upper rearmost back member extends between upper portions of the arms.

20. A wall-proximity reclining seating unit, comprising:

a frame having a back member and a pair of arms, the back member extending between the arms;

a backrest;

a seat having a seat frame;

a first footrest;

a reclining mechanism connected between the frame, backrest, seat, and first footrest, the reclining mechanism comprising a series of pivotally interconnected links and configured to move the seating unit between: (a) an upright position, in which the backrest is disposed at a first generally upright backrest angle, the seat is disposed at a first generally horizontal seat angle, and the first footrest is retracted below a forward portion of the seat; (b) a TV position, in which the backrest substantially maintains the first backrest angle, the seat substantially maintains the first seat angle, and the first footrest is disposed generally horizontally and in front of the seat; and (c) a fully reclined position, in which the backrest is disposed at a second backrest angle that is shallower than the first backrest angle; and a linear actuator comprising an energizing unit, a rail, and a carriage that is movable along the rail, wherein the carriage is connected with the reclining mechanism;

wherein the reclining mechanism includes a footrest linkage that is configured to move the first footrest between the upright and TV positions, and further includes a reclining linkage that is configured to move the seat and backrest relative to the frame from the TV position to the fully reclined position; and wherein the reclining linkage comprises a foundation link mounted to one of the arms, a carrier link, front and rear recline links pivotally attached to the foundation link and the carrier link, and front and rear pivot links pivotally attached to the carrier link and to the seat frame.

* * * * *